US005731272A

United States Patent [19]

Tanaka et al.

[11] Patent Number: 5,731,272

[45] Date of Patent: Mar. 24, 1998

[54] LUBRICANT AND METHOD OF MANUFACTURING BRIQUETTE USING THE SAME

[75] Inventors: Yoshiro Tanaka, Tokyo, Japan; Masaki Miyake, Bolivar, Venezuela; Osamu Tsuge; Yutaka Inada, both of Kobe, Japan; Coomarasamy Thirulingham, Bolivar, Venezuela

[73] Assignee: Kabushiki Kaisha Kobe Seiko Sho, Kobe, Japan

[21] Appl. No.: 732,586

[22] Filed: Oct. 15, 1996

Related U.S. Application Data

[63] Continuation of Ser. No. 439,122, May 11, 1995, abandoned.

[51] Int. Cl.[6] ..... C10M 159/06; B28B 7/36

[52] U.S. Cl. ..... 508/133; 106/38.25; 106/38.8

[58] Field of Search ..... 106/38.25, 38.8; 508/133

[56] References Cited

U.S. PATENT DOCUMENTS

| | | | |
|---|---|---|---|
| 1,340,855 | 11/1920 | Weiss | 44/311 |
| 1,984,214 | 12/1934 | Heitmann | 252/16 |
| 2,476,933 | 7/1949 | Wallace | 106/38.25 |
| 2,544,598 | 3/1951 | Kalina | 106/38.25 |
| 2,668,774 | 2/1954 | Heyl | 106/38.25 |
| 3,037,873 | 6/1962 | Ingala | 106/38.25 |
| 4,017,433 | 4/1977 | Farrington | 106/38.8 |
| 4,264,458 | 4/1981 | Campbell | 508/133 |
| 4,282,039 | 8/1981 | Bullough | 106/38.25 |
| 4,537,600 | 8/1985 | Tajima et al. | 44/311 |

FOREIGN PATENT DOCUMENTS

| | | |
|---|---|---|
| 57-54232 | 3/1982 | Japan . |
| 57-89442 | 6/1982 | Japan . |
| 60-100635 | 6/1985 | Japan . |
| 713101 | 3/1995 | Japan . |

OTHER PUBLICATIONS

CA 122:295776u, 1995.

*Primary Examiner*—Jerry D. Johnson

*Attorney, Agent, or Firm*—Oblon, Spivak, McClelland, Maier & Neustadt, P.C.

[57] ABSTRACT

Disclosed is a method of manufacturing briquettes of reduced iron, wherein a residual oil on distillation containing petroleum asphalt or petroleum pitch is sprayed on the surfaces of rolls. The petroleum asphalt or petroleum pitch are thermally cracked into hydrocarbon gas and carbon by the heat (650° to 750° C.) of the reduced ion. This makes it possible to prevent briquettes from sticking on roll pockets, and hence to provide stable operation of the briquette manufacturing apparatus.

25 Claims, 4 Drawing Sheets

LUBRICANT AND METHOD OF MANUFACTURING BRIQUETTE USING THE SAME

This application is a Continuation of application Ser. No. 08/439,122, filed on May 11, 1995, now abandoned.

BACKGROUND OF THE INVENTION

1. Field of the Invention

The present invention relates to a lubricant used for manufacturing briquettes by pressing a reduced iron obtained in a direct reduction process. In particular, the present invention concerns a method of manufacturing briquettes by contriving the usage of the lubricant.

2. Description of the Related Art

Reduced iron is manufactured by a direct reduction process, wherein iron ores are charged in a reduction furnace and are contacted with a reducing gas mainly containing hydrogen and carbon monoxide usually at a high temperature between 750° and 950° C.

When the reduced iron manufactured by the direct reduction process is contacted with the atmospheric air at a high temperature near the above reducing temperature, it instantly generates a high thermal energy and is thus oxidized. In general, the contact between the reduced iron and the atmospheric air is suppressed by a method of cooling the reduced iron before discharging it to the outside, or briquetting the reduced iron while preventing the contact with the atmospheric air for lowering the surface area thereof. In the case of the former, the reduced iron produced in the reduction furnace is cooled by a cooling inert gas circulated in the reducing furnace and discharging it as a product. In the case of the latter, the reduced iron thus produced is supplied to a briquette manufacturing apparatus whilst being kept at the high temperature and is briquetted, after which it is cooled by air or water and is then discharged as a product.

FIG. 4 is a sectional view showing a pressing apparatus for manufacturing briquettes. In this figure, numerals 7 and 8 designate forming rolls, which are oppositely rotated in the state of being pressed against each other with a specified pressure. Numeral 2 designates a screw feeder in which reduced iron 5 supplied from a reduction furnace is charged. Numeral 1 designates a charge port of the screw feeder 2. Numeral 6 designates a motor to which a shaft 4 is vertically connected. Numeral 3 designates a screw spirally mounted to the shaft 4. Numeral 9 is a strand formed of briquettes joined in a band shape, and 13 is each briquette which is cut from the strand. Numeral 12 designates a strand chute for leading the strand 9, 11 is a separator, and 10 designates impact bars mounted around the separator 11.

FIG. 5 is a perspective view showing one example of the surface of a forming die of each of the rolls 7 and 8 of FIG. 4. In this figure, numeral 21 is a roll pocket which is a rectangular recess provided on the surface of the forming die. Numerals 22 and 23 are land areas which show the land portions around the roll pocket 21.

A method of manufacturing briquettes will be described below.

The form of the reduced iron 5, which is discharged from the reduction furnace and is supplied from the charge port 1 in the screw feeder 2 while avoiding contact with the atmospheric air, depends on the operating method of the reduction furnace. In the case of using a shaft furnace, the reduced iron 5 is formed as a sponge iron having a maximum particle size of 30 mm and an average particle size of 8 to 20 mm, and is kept at 650° to 750° C. The sponge iron 5 is press-fed downward by the screw 3, and is introduced into a space between the rolls 7 and 8 which are rotated at the same speed in the same direction as the flow of the reduced iron 5.

The rolls 7 and 8 are heated by the contact with the reduced iron 5 at a high temperature (650° to 750° C.), but they are cooled from the interior using cooling water for keeping the surface temperature at 300° to 450° C. The roll pockets 21 having the same size are provided on the surfaces of the forming dies of the rolls 7 and 8 in the same arrangement (see FIG. 5). The timing of the rotation of the rolls is adjusted such that the geometrical positions of the two rolls become symmetric.

The sponge iron 5 is pressed in briquettes according to the recessed shapes of the roll pockets 21 formed between the rolls 7 and 8. The adjacent briquettes are joined to each other, and come away from the rolls 7 and 8 in the form of a strand 9. The strand 9 is slid along a strand guide chute 12, and it is hit by the impact bars 10 through the rotation of a separator 11 such that the portions of the land areas 22 and 23 being thin in thickness are bent, and the strand is thus separated into individual briquettes 13.

The above method of manufacturing briquettes, however, has the disadvantages that the strand released from the pressing is difficult to be smoothly separated from the surfaces of the rotating rolls, so that it is not suitably led along the strand chute, which obstructs the separation of the strand into individual briquettes by the separator; and that the strand tends to slip away from the strand chute thereby generating a blockage between the separator and the strand chute, and in some cases the strand is not separated from the rolls at all and is rotated together with the rolls. In such a case, the operation of the briquette manufacturing apparatus is stopped, and the strand causing the blocking must be removed or the roll pockets must be cleaned.

To cope with the above disadvantages, the present inventors have studied on the basis of the thought that the above separation may be certainly performed by lubricating the surface of the forming die of the roll.

When manufacturing briquettes of coal powder, chemical fertilizer, metal powder or ore powder by pressing, as an external lubricant for reducing the frictional resistance between the raw powder and the surface of a roll, there has been used water, talc, lubricating oil, glycerol, magnesium stearate, molybdenum disulfide, silicon resin, ethylene glycol, graphite or paraffin.

However, the conventional lubricant is not suitable for manufacturing briquettes of reduced iron at a high temperature. In manufacturing briquettes of reduced iron, the surface temperature of a roll reaches 450° C., and therefore a lubricant which is not evaporated or cracked at the above temperature (450° C.), and which is effectively stuck and left on the surface of the roll, is required. The conventional lubricant can not satisfy these conditions.

For example, as the test for examining graphite as the lubricant, in manufacturing briquettes of reduced iron, graphite which is solid at room temperature was suspended in water or petroleum fraction and the thus formed suspension was sprayed on the surface of each forming die of rolls 7 and 8.

As a result, the following problems were revealed. Namely, it was difficult to uniformly suspend a powder of graphite in water in oil. The graphite itself often blocked an injection port or a valve of a piping. Moreover, the water or the oil of the suspension medium was evaporated on the surface of the roll, and part of graphite was released from the surface of the roll together with the vapor; or the residual graphite remaining after evaporation become the dry powder state, resulting in a reduced yield. Additionally, the operation cost is high because of the high cost of graphite.

SUMMARY OF THE INVENTION

An object of the present invention is to provide a lubricant for smoothly separating a briquette strand from rolls. Another object is to provide a method of stably manufacturing briquettes using a briquette manufacturing apparatus to which the above lubricant is applied.

To achieve the above objects, according to the present invention, there is provided a lubricant stuck on a forming die in manufacturing briquettes of reduced iron by pressing, comprising one of the following:

(1) petroleum asphalt or petroleum pitch; or (2) residual oil on distillation containing petroleum asphalt or petroleum pitch in a petroleum refining process; or (3) liquid mixture in which said petroleum asphalt, said petroleum pitch or said residual oil on distillation is dissolved and dispersed in a liquid petroleum fraction; or (4) asphalt emulsion formed by suspending or emulsifying said petroleum asphalt or petroleum pitch in water; or (5) asphalt emulsion formed by suspending or emulsifying said residual oil on distillation in water; or (6) asphalt emulsion formed by suspending or emulsifying said liquid mixture in water.

For the petroleum asphalt or petroleum pitch (hereinafter, often called only asphalt) which is the main component of the above lubricant, a substance containing the petroleum asphalt specified in JIS K 2207 and having a softening point ranging from 0° to 150° C. or a penetration (0.1 mm at 25° C.) ranging from 0 to 300 is mainly used.

The above residual oil on distillation referred to in (2) above is an oil which is extracted from a petroleum refinary in a crude oil refining process, and which preferably contains petroleum asphalt or petroleum pitch in an amount of 20 wt % or more.

The liquid mixture referred to in (3) above is obtained by cut-back of the above asphalt or residual oil on distillation with a liquid petroleum fraction such as gasoline, lamp oil, gas oil, lubricating oil, and which preferably contains petroleum asphalt or petroleum pitch in an amount of 20 wt % or more.

The asphalt emulsion referred to in (4) above is obtained by emulsifying the above asphalt, residual oil on distillation or liquid mixture being an emulsifier such as cation emulsifier, anion emulsifier etc., non-ion emulsifier, and which preferably contains asphalt in an amount of 2 wt % or more.

Moreover, according to the present invention, there is provided a method of manufacturing briquettes of reduced iron using a press, comprising the steps of:

heating and melting the lubricant, and spraying and sticking it onto the surface of a forming die of the press or;

pulverizing the solid lubricant, and applying the thus formed powder onto the surface of a forming die of the press using gravity or a gas flow; or spraying the liquid lubricant on the surface of a forming die of the press.

Additionally, according to the present invention, preferably, the amount of application of the lubricant is in the range from 0.01 g/hr to 1.0 g/hr (converted value to the petroleum asphalt or petroleum pitch contained in the lubricant) per 1 $cm^2$ surface area of the die portion of the forming die.

DETAILED DESCRIPTION OF THE PREFERRED EMBODIMENT

The function of asphalt as the main component of the lubricant will be described.

In manufacturing briquettes, the surface of each forming die of a press, that is, the surface of a roll is usually heated at 300° to 450° C. Asphalt does not evaporate very much at this temperature (300° to 450° C.), and thereby it remains on the surface of the roll.

Figure 4:
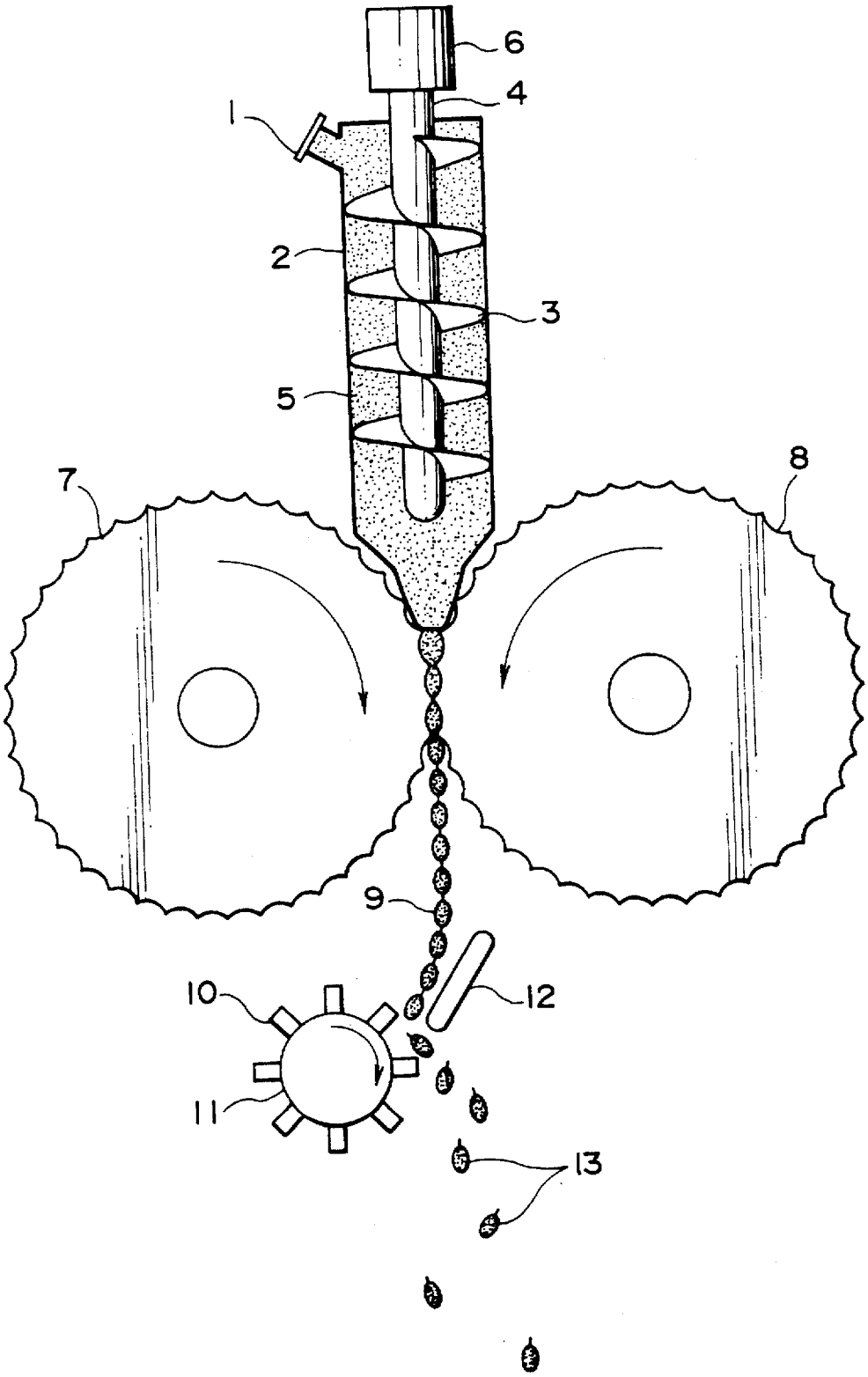
FIG. 4 is a sectional view showing a press for manufacturing briquettes.
Figure 5:
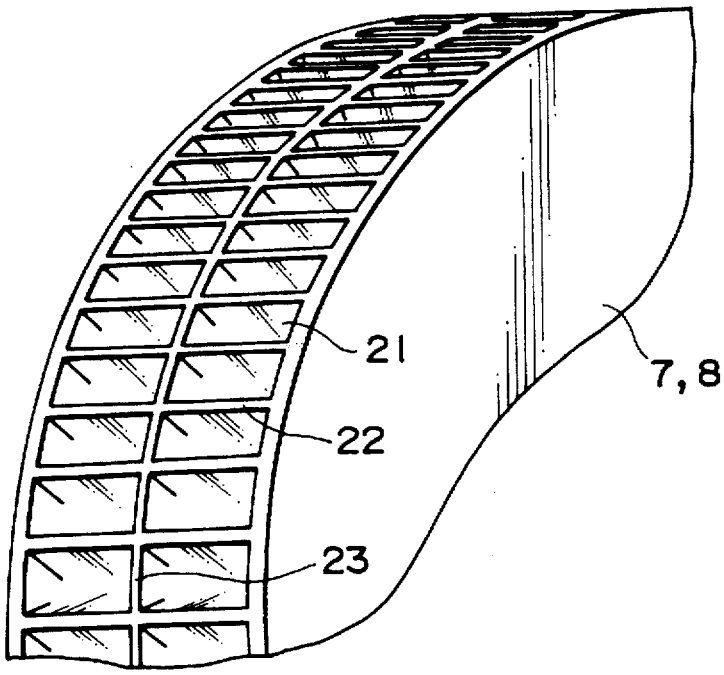
FIG. 5 is a perspective view of the surface of a roll in a briquette manufacturing apparatus.

When the asphalt stuck on the surfaces of the rolls 7 and 8 are contacted with reduced iron 5 at 650° to 750° C. by the rotation of the rolls 7 and 8 (see FIG. 4), it is cracked into hydrocarbon gas and carbon by the heat of the reduced iron 5. In the step when the reduced iron 5 is pressed between the rolls 7 and 8 and is formed into briquettes, the hydrocarbon gas produced forms a thin gas boundary film between the surface of each roll pocket and the briquette, and the carbon remains on the surface of the roll pocket and serves as lubricant for reducing the frictional force of the surface of the roll pockets produced upon forming the briquette. Through these two effects, a briquette strand 9 is separated properly from the rolls 7 and 8.

In the conventional process of manufacturing briquettes, a fine powder of reduced iron easily becomes stuck in the roll pocket, which forms scales to create a thin layer on the surface of the roll pocket, and this thin layer gradually grows. The scale is sintered porous material and is bonded on the surface of the roll pocket by a pressure applied between the rolls upon forming briquettes, and it obstructs the smooth separation of briquettes from the roll pocket. Accordingly, in the conventional manner, the operation has to be periodically stopped for removing the scales.

However, by sticking the lubricant of the present invention on the surface of the roll pockets, even when the scales are stuck thereon, the carbon produced by the thermal cracking fills the spaces of the above sintered porous material thereby changing the scale into a more rigid material. It is considered that the rigid scale is separated from the surface of the roll by the expansion and the contraction caused by the repeated cooling and heating which is generated by the rotation of the roll. Accordingly, in the present invention, the scale is separated, thus keeping the roll pockets in a clean state.

When graphite is used as a lubricant in place of asphalt, the graphite is pulverized and stuck on the surface of the roll using gravity or gas flow. However, the graphite powder has little bondability, resulting in a large loss. On the other hand, in the case that a suspension of graphite powder in water or oil is sprayed on the roll by a spray, the water or oil is evaporated instantly after being sprayed on the surface of the roll, and the graphite dries resulting in a large loss.

On the contrary, since asphalt which is the main component of the lubricant of the present invention is in a liquid state under the temperature condition of the roll surface, that is, at 300° to 450° C., it is excellent in terms of affinity with the surface of the roll pocket, and is effectively stuck thereupon with only a small loss.

Next, the lubricant composed of a liquid mixture or residual oil on distillation will be described.

If pure petroleum asphalt or petroleum pitch is used as the main component, since the petroleum asphalt is in the solid state at room temperature, it cannot be sprayed as it is. The asphalt must be heated and melted or pulverized. To cope with this inconvenience, the asphalt is cut-back by a liquid petroleum fraction, to give a fluidity, thus forming a liquid mixture at room temperature. This liquid mixture can be sprayed at room temperature.

The added liquid petroleum fraction is released from the roll surface as oil smoke by the heat of the roll when being sprayed on the surface of the roll. The oil smoke deteriorates the work environment near the briquette forming machine. The added amount of the liquid petroleum fraction should be sufficient to give a fluidity to the asphalt for forming the easy-to-handle state, but in the viewpoint of economy, the added amount of the liquid petroleum fraction is desired to be small. Taking into consideration that a liquid petroleum fraction having a relatively high viscosity could be used for the cut-back, the content of asphalt is specified to be 20 wt % or more in order to ensure sufficient fluidity.

In the case of using lamp oil or gas oil, which have a low viscosity as a liquid petroleum fraction, even for additions resulting in the content of asphalt being in the range 70 to 80%, the asphalt is sufficiently fluidized to be easily handled.

The residual oil on distillation contains a liquid petroleum fraction having a low viscosity, other than the above asphalt, and it is in the fluidized state at room temperature. Even in this case, it can be sprayed as it is at room temperature, and is not required to be cut-back. Moreover, from the viewpoint of cost, with respect to the asphalt, the residual oil on distillation is cheaper than asphalt which has been cut-back by another liquid petroleum fraction; and further, in this case, the cost for performing the cut-back is eliminated.

In the case that the above residual oil on distillation has a high viscosity and cannot be preferably sprayed by a spray, it may be heated a little or cut-back by a small amount of an other liquid petroleum fraction.

The asphalt content of the residual oil on distillation or the liquid mixture formed by cut-back of the residual oil on distillation is preferably in the range of 20 wt % or more.

Next, the lubricant composed of asphalt emulsion will be described.

For the above residual oil on distillation or liquid mixture, the petroleum fractions, other than the asphalt component, contained therein almost all have a boiling point less than the surface temperature of the roll. As a result, when the lubricant is sprayed onyo the surface of the roll, the petroleum fraction is instantly vaporized and separated from the asphalt component, thus generating oil vapor. The oil vapor deteriorates the environment of the production field, and condenses on the low temperature portions of the apparatus, thereby accelerating the deposition of dust. Thus, there occurs a problem that the removal of this takes a lot of time.

In the case of the asphalt emulsion, water is used for giving a fluidity to the asphalt or for adjusting the viscosity of the asphalt, so that the above problem can be eliminated. Namely, when the asphalt emulsion is sprayed on the surface of the roll by the spray, water content is instantly evaporated by the heat of the roll; however, this steam does not harm the environment. Water is inexpensive, so that even an asphalt emulsion using a large amount of water is economically viable. In the case of asphalt emulsion, the roll is cooled by the latent heat of evaporation water. The asphalt remaining after the evaporation of water has the effect of promoting the separation of briquettes from the roll.

Even the largely diluted asphalt emulsion can achieve the sufficient separating effect, and has not the inconveniences of the above liquid mixture and the residual oil on distillation. As a result, the content of asphalt in the asphalt emulsion is sufficient to be 2 wt % or more.

Asphalt is not dispersed in water simply by the mixing; however, by dividing the asphalt into particles of several tens of microns or less using an emulsifier, it can be dispersed by the function of the emulsifier.

Asphalt is in the solid state at room temperature, so that it cannot be emulsified unless it is heated to be fluidized. However, using the above residual oil on distillation or liquid mixture in the fluidized state at room temperature, which contains a petroleum fraction in small amount, it becomes possible to emulsify the asphalt at room temperature while suppressing the generation of oil vapor tp a minimum.

Petroleum asphalt or petroleum pitch to be used as the main component of the lubricant is commercially available as road pavement, water-proof and electrical insulation, and is easily obtained at a low cost.

Next, a method of manufacturing briquettes will be described.

In the case that the lubricant is in the solid state or in the liquid state having a high viscosity, it is heated and melted at a temperature greater than the pour point to obtain a sufficient fluidity, and is sprayed and stuck on the surface of a forming die (surface of the roll).

Alternatively, in the case that the lubricant is in the solid state, the powder is pulverized and is then scattered on the surface of the roll using gravity or gas flow, so that it can be melted and stuck on the surface of the roll by the heat of the roll.

In the above heating, heating apparatuses must be provided on all equipments of the asphalt spray facility such as the storage tank and the piping. Moreover, in the case of using the above powder, cost of asphalt pulverizing apparatus is required, and the asphalt powder is often softened by the heat from the environment at high temperature and thereby the powder is difficult to be effectively stuck and melted on the surface of the roll. On the contrary, the lubricant in the liquid state at room temperature does not have the above problem, and can be stuck on the surfaces of the roll by spraying as it is. The briquettes are thus easily separated from the roll pockets by the effect of the lubricant.

In the present invention, the amount of application of the asphalt as a main component of the lubricant is specified to be in the range from 0.01 to 1.0 g/hr per unit surface area (1 $cm^2$) of the die portion of the forming die, that is, the roll pocket. When it is less than 0.01 g/hr, a sufficient separating effect cannot be obtained. When it is more than 1.0 g/hr, the lubricant is burned to generate oil smoke, which causes problems in the whole operation of the press.

The present invention will be more clearly understood by way of the following examples.

(EXAMPLE 1)

Figure 1:
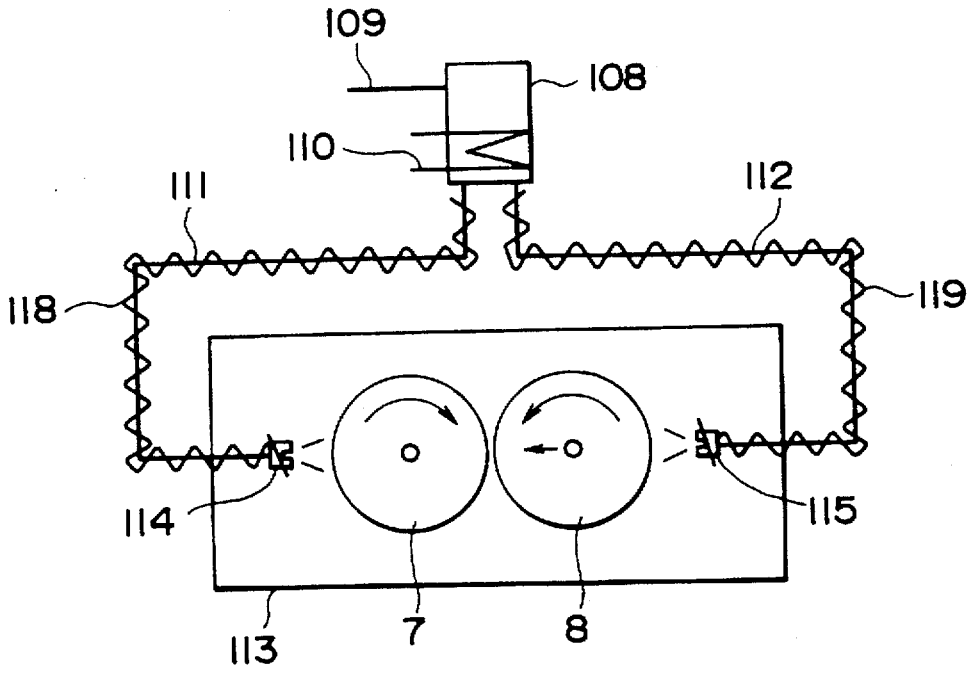
FIG. 1 is a schematic view showing a manufacturing apparatus used for a briquette manufacturing method according to a first example of the present invention.

FIG. 1 is a schematic view showing a manufacturing apparatus used for a briquette manufacturing method according to a first example of the present invention. In this figure, numeral 113 is a briquette machine; and 114 and 115 are spray nozzles for spraying a lubricant to rolls 7 and 8. Numeral 108 is a vessel; 110 is a heating coil for heating a lubricant in the vessel 108; 109 is a pipe for introducing an inert gas; 111 and 112 are pipes for feeding a lubricant to the spray nozzles 114 and 115; and 118 and 119 are heating coils for heating the pipes 111 and 112 and the spray nozzles 114 and 115. For each of the rolls 7 and 8, the diameter is 1000 mm, the width is 270 mm, and the rotational speed is about 15 rotations/min.

The operation of the briquette manufacturing apparatus will be described below.

A straight asphalt 60/80 (equivalent to JIS K 2207) as a lubricant was charged in the vessel 108, and was heated and melted at 150° C. by the heating coil 110. The vessel 108 was pressurized at a pressure of 5 kg/cm$^2$ by an inert gas introduced from the pipe 109. The melted asphalt in the vessel 108 was supplied to the spray nozzles 114 and 115 through the pipes 111 and 112 by the pressure applied in the interior of the vessel 108. The pipes 111 and 112, and the spray nozzles 114 and 115 were kept at about 150° C. by means of the heating coils 118 and 119 so as to prevent the solidification of the melted asphalt. The sprayed amounts of the melted asphalt from the spray nozzles 114 and 115 to the surfaces of the rolls 7 and 8 were adjusted to be almost equal to each other. Briquettes were thus manufactured using the briquette machine 113 in the same manner as the conventional one while spraying the lubricant to the rolls 7 and 8. The operation of the briquette machine 113 was continuously performed for 96 hrs. The total sprayed amount of the melted asphalt was obtained by measurement of the reduced level of the melted asphalt in the vessel 108. As a result, the average sprayed amount for 96 hrs was 0.05 g/hr per unit surface area (1 cm$^2$) of the roll.

During the spray of the melted asphalt for 96 hrs, a briquette strand could be smoothly separated from the rolls 7 and 8, and the briquette forming machine 113 was stably operated without any stoppage.

The surfaces of the rolls 7 and 8 after the operation for 96 hrs were observed, which gave the result that very few scales were generated on the surface of the roll pockets. The separated scales were observed at the bottom of the apparatus. On the other hand, in manufacturing briquettes without any lubricant as in the conventional manner, the scales were deposited on the surfaces of the rolls.

(EXAMPLE 2)

Figure 2:
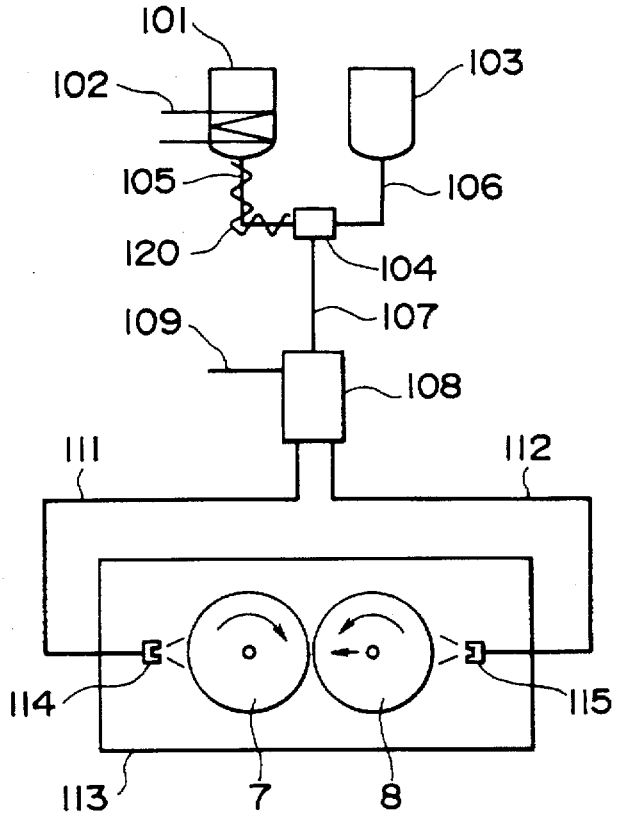
FIG. 2 is a schematic view showing a manufacturing apparatus used for a briquette manufacturing method according to second, fourth and fifth examples of the present invention.

FIG. 2 is a schematic view showing a manufacturing apparatus of a briquette manufacturing method according to a second example of the present invention. In this figure, parts corresponding to those in FIG. 1 are designated by the same numerals. Numeral 101 is a vessel in which a straight asphalt as a lubricant is put; 102 is a heating coil for heating the straight asphalt in the vessel 101; and 103 is a vessel in which a gas oil as a liquid petroleum fraction is put. Numeral 104 is an emulsifier for receiving the melted asphalt in the vessel 101 and the gas oil in the vessel 103 through the pipes 105 and 106 and mixing them. Numeral 120 designates a heating coil for preventing the solidification of asphalt in the pipe 105. Numeral 107 designates a pipe for connecting the vessel 108, in which a lubricant is put, to the emulsifier 104.

Next, the operation of the apparatus will be described.

A straight asphalt 60/80 (equivalent to JIS K-2207) was put in the vessel 101, and was heated and melted at 150° C. by means of the heating coil 102. A gas oil (equivalent to gas oil No. 1 in JIS K 2204) was charged in the vessel 103. The melted asphalt and the gas oil were supplied to the emulsifier 104 through the pipes 105 and 106 while the flow rates were adjusted such that the volume ratio of the melted asphalt to the gas oil was 2:1. The melted asphalt and the gas oil were sufficiently mixed, and then stored in the vessel 108 through the pipe 107. In addition, the mixture of the asphalt and the gas oil, that is, the lubricant stored in the vessel 108 is in the liquid state at room temperature, and accordingly, a heating coil is not required for the subsequent portions of the apparatus.

Like the above example, the vessel 108 was pressurized at a pressure of 5 kg/cm$^2$ by an inert gas introduced through the pipe 109, so that the liquid mixture in the vessel 108 was sprayed to the rolls 7 and 8.

Briquettes were thus continuously manufactured for one week while spraying the liquid mixture (lubricant) onto the rolls 7 and 8.

The average sprayed amount of the mixture for one week was 0.15 cc/hr, or 0.1 g/hr (converted value to the asphalt as a main component) per unit surface area (1 cm$^2$) of the roll.

During the spray of the liquid mixture (lubricant) for one week, the briquette strand was smoothly separated, and accordingly, there was no stoppage of the briquette machine due to the briquette strand not being smoothly separated from the rolls. The briquette machine could be thus stably operated.

In addition, the mixing ratio of the liquid mixture may be freely selected so long as the content of the asphalt as a main component is kept to be 20 wt % or more.

(EXAMPLE 3)

Figure 3:
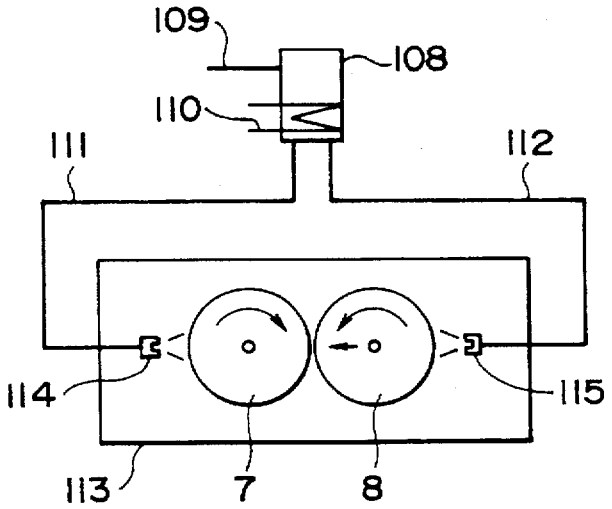
FIG. 3 is a schematic view showing a manufacturing apparatus used for a briquette manufacturing method according to a third example of the present invention.

FIG. 3 is a schematic view showing the portion of a briquette manufacturing apparatus according to a third example of the present invention. In this figure, parts corresponding to those in FIG. 1 are designated by the same numerals. A residual oil on distillation is used as a lubricant stored in the vessel 108. The residual oil on distillation is obtained from a petroleum refinary, and contains 45 vol % of asphalt as a main component and has a pour point of 15° C. or less.

The residual oil on distillation charged in the vessel 108 was heated at 80° C. by means of the heating coil 110, to lower the viscosity thus increasing the fluidity. Next, like the second example, the vessel 108 was pressurized at a pressure of 5 kg/cm$^2$ by an inert gas introduced through the pipe 109. Briquettes were thus continuously manufactured for 72 hrs while spraying the residual oil onto distillation on the surfaces of the rolls 7 and 8. The average sprayed amount of the residual oil on distillation for 72 hrs was 0.35 cc/hr, or 0.16 g/hr (converted value to asphalt as a main component) per the unit surface area (1 cm$^2$) of the roll.

During the spray (72 hrs) of the residual oil on distillation (lubricant), the surfaces of the roll pockets were kept to be cleaned, and the briquette strand was smoothly separated from the rolls, and there were no stoppages of the briquette machine 113 due to the briquette strand not being separated from the surfaces of the rolls. The briquette manufacturing apparatus was thus stably operated.

In addition, when the residual oil on distillation has a sufficient fluidity, it is not necessary to provide a heating coil 110.

(EXAMPLE 4)

In this example, briquettes were manufactured using the same briquette manufacturing apparatus as shown in FIG. 2, wherein the vessel 103 was filled with water added with an emulsifying agent in place of the gas oil.

A straight asphalt 60/80 (equivalent to JIS K 2207) was charged in the vessel 101, and was heated and melted at 150° C. by means of the heating coil 102. Water was charged in the vessel 103, and then a non-ion type liquid emulsifying agent was added to water in an amount of 5 wt %, and the two were then mixed with each other. The melted asphalt and water containing the emulsifying agent were supplied through the pipes 105 and 106 to the emulsifier 104 while the flow rates were adjusted such that the volume ratio of the melted asphalt to water containing the emulsifying agent was 3:7. In this emulsifier 104, the asphalt was sufficiently emulsified into asphalt emulsion, which was stored in the vessel 108 through of the pipe 107.

Next, like the second and third examples, the vessel 108 was pressurized at 5 kg/cm$^2$ by an inert gas introduced through the pipe 109 and the asphalt emulsion in the vessel 108 was sprayed to the rolls 7 and 8 of the briquette machine 113. Even in this example, since the asphalt emulsion is liquid, the vessel 108, pipes 111 and 112 and spray nozzles 114 and 115 do not require any heating coil.

Briquettes were thus continuously manufactured for one week while spraying the asphalt emulsion to the rolls 7 and 8. The average sprayed amount of the asphalt emulsion for one week was 0.20 cc/hr, 0.06 g/hr (converted value to asphalt as a main component) per unit surface area (1 cm$^2$) of the roll.

During the spray of the asphalt emulsion for one week, the briquette strand could be smoothly separated from the rolls, and there were no stoppages of the briquettes machine due to the briquette strand not being smoothly separated from the rolls.

In the second example, the liquid mixture of asphalt and gas oil was sprayed on the surfaces of the rolls and thereby gas oil vapor was generated; however, in this example when the asphalt emulsion was sprayed on the surfaces of the rolls, generation of such oil vapor was not recognized at all.

In addition, to form the above asphalt emulsion, asphalt may be mixed with water in all kinds of proportions, so long as the content of asphalt is 2 wt % or more.

(EXAMPLE 5)

In the fourth example (see FIG. 2), the straight asphalt was charged in the vessel 101, and was emulsified in water by the emulsifier 104; however, in this example, a liquid mixture was charged in the vessel 101 and was emulsified in water. The liquid mixture is a out-back asphalt which is cut-back with gas oil in an amount of about 20 vol %. It has a viscosity of about 250 cSt at 60° C. In this case, since the cut-back asphalt has a fluidity at room temperature, the heating coils 102 and 120 are not required.

Water was put in the vessel 103, and a non-ion type liquid emulsifying agent was added to water in an amount of 5 wt %, and the two were then mixed with each other. The cut-back asphalt and water containing the emulsifying agent were supplied through the pipes 105 and 106 to the emulsifier 104 while the flow rates were adjusted such that the volume ratio of the cut-back asphalt to the water containing the emulsifying agent was 1:5. The cut-back asphalt was emulsified, to prepare the asphalt emulsion. The asphalt emulsion was stored in the vessel 108 through the pipe 107. Since the asphalt emulsion stored in the vessel 108 is a liquid having a low viscosity, heating by a heating coil is not required. Next, like the second, third and fourth examples, the vessel 108 was pressurized at a pressure of 5 kg/cm$^2$ by an inert gas introduced through the pipe 109, and briquettes were continuously manufactured for 72 hrs while spraying the asphalt emulsion in the vessel 108 to the rolls 7 and 8. The average sprayed amount for 72 hrs was 0.50 cc/hr, or 0.07 g/hr (converted value to asphalt as a main component) per unit surface area (1 cm$^2$) of the roll.

Even in this example, during the spray, the surfaces of the roll pockets were kept to be clean, and the briquette strand could be smoothly separated from the roll, and there were no stoppages of the briquette machine 113 the briquette strand not being separated from the surfaces of the rolls.

What is claimed is:

1. A method of manufacturing briquettes of reduced iron using a press containing a plurality of forming dies, each die having a surface thereon, which comprises applying a lubricant to the surface of each die, supplying said reduced iron at a temperature of 650°–750° C. to said dies, thereby heating said dies, forming said briquettes in said dies, and then releasing said briquettes from said dies, wherein the lubricant is petroleum asphalt or petroleum pitch.

2. The method of claim 1, wherein the applying step includes heating and melting said lubricant, and spraying said lubricant onto the surfaces of the forming dies of said press.

3. The method of claim 1, wherein the applying step includes pulverizing said lubricant in solid form to form a powder, and melting said powder onto the surface of the forming dies of said press using gravity or gas flow.

4. The method of claim 1, wherein the amount of application of said lubricant is in the range from 0.01 g/hr to 1.0 g/hr (converted value to the petroleum asphalt or petroleum pitch containing in said lubricant) per unit surface area of 1 cm$^2$ of the die portions of said forming dies.

5. The method of claim 1, wherein the plurality of forming dies comprise pockets on two forming rolls which rotate in opposite directions and which are pressed against each other so as to continuously form a strand of briquettes joined in a band shape, and wherein each briquette is then cut from the strand.

6. A method of manufacturing briquettes of reduced iron using a press containing a plurality of forming dies, each die having a surface thereon, which comprises applying a lubricant to the surface of each die, supplying said reduced iron at a temperature of 650°–750° C. to said dies, thereby heating said dies, forming said briquettes in said dies, and then releasing said briquettes from said dies, wherein the lubricant is residual oil on distillation containing petroleum asphalt or petroleum pitch in an amount of 20% or more in a petroleum refining process.

7. The method of claim 6, wherein the applying step includes spraying said lubricant onto the surface of the forming dies of said press.

8. The method of claim 6, wherein the amount of application of said lubricant is in the range from 0.01 g/hr to 1.0 g/hr (converted value to the petroleum asphalt or petroleum pitch contained in said lubricant) per unit surface area of 1 cm$^2$ of the die portions of said forming dies.

9. The method of claim 6, wherein the plurality of forming dies comprise pockets on two forming rolls which rotate in opposite directions and which are pressed against each other so as to continuously form a strand of briquettes joined in a band shape, and wherein each briquette is then cut from the strand.

10. A method of manufacturing briquettes of reduced iron using a press containing a plurality of forming dies, each die having a surface thereon, which comprises applying a lubricant to the surface of each die, forming said briquettes in said dies, and then releasing said briquettes from said dies, wherein the lubricant is a liquid mixture in which petroleum asphalt, petroleum pitch or residual oil on distillation containing petroleum asphalt or petroleum pitch in an amount of 20% or more is dissolved and dispersed in a liquid petroleum fraction.

11. The method of claim 10, wherein the applying step includes spraying said lubricant onto the surface of the forming dies of said press.

12. The method of claim 10, wherein the amount of application of said lubricant is in the range from 0.01 g/hr to 1.0 g/hr (converted value to the petroleum asphalt or petroleum pitch contained in said lubricant) per unit surface area of 1 $cm^2$ of the die portions of said forming dies.

13. The method of claim 10, wherein the plurality of forming dies comprise pockets on two forming rolls which ritate in opposite directions and which are pressed against each other so as to continuously form a strand of briquettes joined in a band shape, and wherein each briquette is then cut from the strand.

14. A method of manufacturing briquettes of reduced iron using a press containing a plurality of forming dies, each die having a surface thereon, which comprises applying a lubricant to the surface of each die, supplying said reduced iron at a temperature of 650°–750° C. to said dies, thereby heating said dies, forming said briquettes in said dies, and then releasing said briquettes from said dies, wherein the lubricant is an emulsion formed by suspending or emulsifying petroleum asphalt or petroleum pitch in water.

15. The method of claim 14, wherein said applying step includes spraying said lubricant onto the surface of the forming dies of said press.

16. The method of claim 14, wherein the amount of application of said lubricant is in the range from 0.01 g/hr to 1.0 g/hr (converted value to the petroleum asphalt or petroleum pitch contained in said lubricant) per unit surface area of 1 $cm^2$ of the die portions of said forming dies.

17. The method of claim 14, wherein the plurality of forming dies comprise pockets on two forming rolls which rotate in opposite directions and which are pressed against each other so as to continuously form a strand of briquettes joined in a band shape, and wherein each briquette is then cut from the strand.

18. A method of manufacturing briquettes of reduced iron using a press containing a plurality of forming dies, each die having a surface thereon, which comprises applying a lubricant to the surface of each die, supplying said reduced iron at a temperature of 650°–750° C. to said dies, thereby heating said dies, forming said briquettes in said dies, and then releasing said briquettes from said dies, wherein the lubricant is an emulsion formed by suspending or emulsifying residual oil on distillation containing petroleum asphalt or petroleum pitch in an amount of 20% or more in a petroleum refining process, in water.

19. The method of claim 18, wherein the applying step includes spraying said lubricant onto the surface of the forming dies of said press.

20. The method of claim 18, wherein the amount of application of said lubricant is in the range from 0.01 g/hr to 1.0 g/hr (converted value to the petroleum asphalt or petroleum pitch contained in said lubricant) per unit surface area of 1 $cm^2$ of the die portions of said forming dies.

21. The method of claim 18, wherein the plurality of forming dies comprise pockets on two forming rolls which rotate in opposite directions and which are pressed against each other so as to continuously form a strand of briquettes joined in a band shape, and wherein each briquette is then cut from the strand.

22. A method of manufacturing briquettes of reduced iron using a press containing a plurality of forming dies, each die having a surface thereon, which comprises applying a lubricant to the surface of each die, forming said briquettes in said dies, and then releasing said briquettes from said dies, wherein the lubricant is an emulsion formed by suspending or emulsifying a liquid mixture in which petroleum asphalt, petroleum pitch or residual oil on distillation containing petroleum asphalt or petroleum pitch in an amount of 20% or more is dissolved and dispersed in a liquid petroleum fraction, in water.

23. The method of claim 22, wherein the applying step includes spraying said lubricant onto the surface of the forming dies of said press.

24. The method of claim 22, wherein the amount of application of said lubricant is in the range from 0.01 g/hr to 1.0 g/hr (converted value to the petroleum asphalt or petroleum pitch contained in said lubricant) per unit surface area of 1 $cm^2$ of the die portions of said forming dies.

25. The method of claim 22, wherein the plurality of forming dies comprise pockets on two forming rolls which rotate in opposite directions and which are pressed against each other so as to continuously form a strand of briquettes joined in a band shape, and wherein each briquette is then cut from the strand.

* * * * *